US007212750B2

(12) United States Patent
Kawai

(10) Patent No.: US 7,212,750 B2
(45) Date of Patent: May 1, 2007

(54) IMAGE FORMING DEVICE AND INSERTABLE DEVELOPING UNIT WITH IDENTIFICATION PROTRUSIONS FOR DETERMINING COMPATIBILITY

(75) Inventor: Hideaki Kawai, Mukoh (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 290 days.

(21) Appl. No.: 10/959,673

(22) Filed: Oct. 4, 2004

(65) Prior Publication Data

US 2005/0105922 A1 May 19, 2005

(30) Foreign Application Priority Data

Oct. 6, 2003 (JP) ..... 2003-347557
Oct. 6, 2003 (JP) ..... 2003-347559
Oct. 6, 2003 (JP) ..... 2003-347560

(51) Int. Cl.
*G03G 15/00* (2006.01)

(52) U.S. Cl. ..... 399/12; 399/13

(58) Field of Classification Search ..... 399/12, 399/13, 25, 31, 119, 222, 262
See application file for complete search history.

(56) References Cited

U.S. PATENT DOCUMENTS 4,740,808 A * 4/1988 Kasamura et al. ..... 399/12
4,974,020 A * 11/1990 Takamatsu et al. ..... 399/12
4,978,995 A * 12/1990 Takahashi ..... 399/12
5,909,603 A * 6/1999 Suzuki et al. ..... 399/13
6,104,888 A * 8/2000 Kobayashi ..... 399/12
6,285,836 B1 * 9/2001 Kubota ..... 399/12
6,347,195 B1 * 2/2002 Saiki et al. ..... 399/12
6,483,995 B2 * 11/2002 Iwaki et al. ..... 399/12
6,701,096 B2 * 3/2004 Arai et al. ..... 399/12
6,912,364 B2 * 6/2005 Kim ..... 399/12
2002/0094208 A1 * 7/2002 Palumbo ..... 399/12

FOREIGN PATENT DOCUMENTS

| | | |
|---|---|---|
| JP | 05-249777 | 9/1993 |
| JP | 07-134497 | 5/1995 |
| JP | 10-240080 | 9/1998 |
| JP | 11-258968 | 9/1999 |
| JP | 2001-154483 | 6/2001 |
| JP | 2001-159842 | 6/2001 |

* cited by examiner

*Primary Examiner*—Robert Beatty
(74) *Attorney, Agent, or Firm*—Hogan & Hartson LLP

(57) ABSTRACT

An image forming device includes a device frame, a developing unit which is inserted into the device frame in a prescribed inserting direction, two terminals which are provided in the device frame, a metal conduction member which is provided in the developing unit and makes contact with at least one of the terminals, and a detecting unit which detects a presence or an absence of continuity between the terminals. Identification protrusions are fixed on an upper surface of the developing unit for determining compatibility between the developing unit and device frame.

21 Claims, 11 Drawing Sheets

IMAGE FORMING DEVICE AND INSERTABLE DEVELOPING UNIT WITH IDENTIFICATION PROTRUSIONS FOR DETERMINING COMPATIBILITY

BACKGROUND OF THE INVENTION

1. Field of the Invention

The present invention relates to an image forming device such as a copy machine, a printer and a facsimile machine, and more particularly to an image forming device in which a developing unit is inserted removably.

2. Description of the Related Art

Various types of image forming devices have been developed from a technical aspect to form an image with a high resolution and an aspect of a business use or a domestic use. As a developing unit which can be inserted into various types of image forming devices, various types of developing units have been developed. Therefore, for an image forming device of a prescribed type, a developing unit compliant with the image forming device of the prescribed type is necessary to be inserted. When a noncompliant developing unit is inserted, there are cases in which the image forming device breaks down. Therefore, it is necessary to ensure compatibility between the image forming device and the developing unit to be inserted.

For example, in a first conventional device, a fuse and a resistance are mounted on a developing cartridge. In the first conventional device, when the cartridge is inserted into the image forming device frame, by the continuity to the fuse, an initial continuity is detected and the fuse is blown out. In addition, a resistance value is checked and a determination is made as to whether the cartridge complies with the device frame.

In a second conventional device, a determination is made as to whether a developing unit is a new one or an old one according to whether a fuse is connected or blown out.

In a third conventional device, an antenna is provided on a cartridge for detecting a remaining amount of toner in a developing unit. A fuse is connected between the antenna and ground. When the antenna detects the remaining amount of toner, if the detection result is the same voltage as ground, a determination is made that the cartridge is new.

In the above-described first, second and third conventional devices, the fuse is attached to the developing unit. When the developing unit is inserted into the device frame, the fuse is blown out. When a used developing unit is inserted into the device frame, since the fuse is already blown out, the continuity is lost. Therefore, it can be recognized at the device frame that the inserted developing unit is a used developing unit. Such a structure enables an accurate detection of old and new developing units by a simple structure. However, the structure is unsuitable for detections other than the detection of old and new developing units.

Therefore, there is a demand for an image forming device which can accurately detect the type of the developing unit by a simple structure.

Moreover, it is not sufficient just to ensure the compatibility of the image forming device and the developing unit as described above. It is preferable to enable an operator to recognize the compatibility. Fourth and fifth conventional devices are proposed in consideration to such a demand.

In the fourth conventional device, a developing unit and an image forming device are provided with an engaging member and an engaged member to be engaged with one another when the developing unit is inserted into the image forming device frame. Therefore, when a developing unit of a different type is inserted into the image forming device, the engaging member and the engaged member are not engaged with one another.

In the fifth conventional device, a developing unit is provided with a connector having contacts of different connections according to a designated image forming device. An image forming device includes an electrical signal relay unit. When the electrical signal replay unit engages with the connector, an electrical signal of a plurality of contacts is read. Then, a determination is made as to whether the inserted developing unit is for that image forming device.

In the above-described fourth and fifth conventional devices, the identification of the developing unit is carried out only once. Therefore, when the number of different types of developing units increases, the image forming device cannot handle these increases. That is, when there exists various types of image forming devices, to acquire identification information of an image forming device from the developing unit by carrying out the identification of the developing unit only once, the developing unit is required to be provided with an identifier indicating many pieces of identification information. In addition, the image forming device is required to carry out processes for reading many pieces of identification information. Therefore, the cost for the developing unit and the image forming device increases.

Thus, there is a demand for a developing unit which can ensure compatibility for various types of developing units and which the compatibility can be recognized easily by the operator, and a method for distinguishing the type of the developing unit.

In the fourth conventional device, a mechanical device and an electrical device are used for ensuring the compatibility. However, when the number of different types of image forming devices increases, the number of patterns relating to the compatibility also increases. Therefore, it is difficult for the fourth conventional device to sufficiently comply with such a large number of patterns.

Thus, there is a demand for an image forming device which can flexibly comply with an increase in the number of different types of image forming devices.

SUMMARY OF THE INVENTION

According to an aspect of the present invention, an image forming device includes a developing unit which is inserted in a prescribed inserting direction into the image forming device. The image forming device includes two terminals provided at the device frame, a metal conduction member and a detecting unit. The conduction member is provided on the developing unit and makes contact with at least one of the terminals. The detecting unit detects a presence or an absence of continuity between the terminals.

As the conduction member, a wire rod shaped to make contact with both of the terminals or a wire rod shaped to make contact with one of the terminals is used.

The image forming device further includes a determination unit which determines whether the developing unit is for initial mounting or for exchange in accordance with a detection signal from the detecting unit.

The developing unit includes a fuse. One terminal of the fuse is connected to one end of the conduction member. Another terminal of the fuse is connected to a different conduction member. In the device frame, a terminal for the fuse is provided to make contact with the different conduction member when the developing unit is inserted. The device frame includes a determination unit which determines whether the developing unit is old or new by energizing between one of the terminals of the fuse and the terminal for the fuse and detecting a presence or an absence of continuity between the terminals. After the detection, the fuse is blown out.

According to the present invention, by detecting the presence or the absence of the continuity between the two terminals by a simple structure including the two terminals of the device frame and the conduction member of the developing unit, the compatibility of the developing unit can be detected accurately. Moreover, since the conduction member is not blown out like the fuse, the determination unit can be used for detections other than the detection of whether the developing unit is new or old.

When comparing the developing unit for initial mounting and the developing unit for exchange, for example, an amount of toner accumulated inside is different. Therefore, different control operations are required to be carried out for an impressed voltage in a developing process and a remaining state of the toner in a detection process of the remaining amount of toner. If the developing unit for initial mounting and the developing unit for exchange are identified by the presence or the absence of the continuity between the two terminals, the control operations can be changed easily.

Since the conduction member is formed of the wire rod and shaped to make contact with both of the two terminals, the continuity state can be established reliably between the two terminals. In case the conduction member is formed to make contact with only one of the two terminals, a non-continuity state can be established reliably. In particular, since the wire rod can be shaped easily by bending, the cost is reduced and an efficiency of work is improved.

Furthermore, the developing unit includes a fuse. One terminal of the fuse is connected to one end of the conduction member. Another terminal of the fuse is connected to a different conduction member. In the device frame, a terminal for the fuse is provided to make contact with the different conduction member when the developing unit is inserted. An energization is carried out between one of the two terminals and the terminal for the fuse. Accordingly, the terminal for detecting the presence or the absence of the continuity of the conduction member can also function as a terminal for energizing the fuse. As a result, the detection of the presence or the absence of the continuity of the conduction member and the fuse can be carried out by an extremely simple structure. When the developing unit is inserted, a determination can be made as to whether the developing unit is new or old by detecting the blown out fuse. In addition, at the same time, the type of the developing unit can be determined by the presence or the absence of the continuity of the conduction member.

According to an aspect of the present invention, a developing unit is inserted in a prescribed inserting direction into an image forming device. The developing unit includes at least one identification protrusion. The identification protrusion is fixed on an upper surface of the developing unit so as to protrude upward, at a plurality of attaching portions arranged in a direction approximately orthogonal to the inserting direction. The developing unit includes a protrusion formed on the upper surface of the developing unit so as to protrude upward at a front side of the inserting direction than the identification protrusion. The developing unit also includes a metal conduction member which makes contact with the terminal of the image forming device.

An inner part of the protrusion is preferable to be a gap connected to an inner part of the developing unit. The identification protrusion is preferable to be fixed on a position of the attaching portion of a combination determined according to the type of developing unit. Furthermore, the conduction member is preferable to be set at a length to bring between the two terminals of the image forming device into conduction or non-conduction.

According to an aspect of the present invention, a method for distinguishing a type of developing unit is a method for distinguishing the type of the above-described developing unit. Two large groups are distinguished according to a presence or an absence of a leveled part. Intermediate groups are distinguished according to the position where the identification protrusion is fixed. Two small groups are distinguished according to the presence or the absence of the continuity of the conduction member.

According to the present invention, when inserting the developing unit into the image forming device, the operator recognizes the compatibility by the protrusion formed on the upper surface of the developing unit. When the compatibility of the protrusion coincides, the operator recognizes the compatibility by the identification protrusion also fixed on the upper surface of the developing unit. When the compatibility of the identification protrusion coincides, the developing unit is inserted and the conduction member makes contact with the terminal of the image forming device. Accordingly, the compatibility is recognized by the image forming device.

The compatibility is recognized in three stages as described above. Therefore, many types of developing units can be identified. Furthermore, the various types of developing units can be classified in a hierarchy. As a result, the identification of the developing units can be carried out easily. With respect to the protrusion and the identification protrusion, the developing unit cannot be inserted when there is no compatibility. Therefore, the operator can easily recognize that there is no compatibility. In addition, at a stage that the developing unit fails to be inserted, the operator can recognize the type of developing unit. Since the image forming device carries out only the recognition of the conduction member, the image forming device is not required to carry out a large number of processes for the type of developing unit.

Furthermore, the inner part of the protrusion is formed as a gap connected to the inner part of the developing unit. Therefore, when inserting the developing unit forcibly by cutting off the protrusion, the cut part opens. As a result, the toner inside the developing unit leaks. Thus, such an injustice can be prevented.

The identification protrusion is fixed on the position of the attaching portion of the combination determined according to the type of developing unit. Therefore, by increasing the number of attaching portions, a larger number of combinations can be set. As a result, the image forming device can easily respond to the number of types of developing units.

By setting the length of the conduction member at the length to bring between the two terminals of the image forming device into conduction or non-conduction, the presence or the absence of the continuity can be set easily and reliably.

According to the method for distinguishing the type of developing unit of the present invention, the developing unit can be distinguished into two large groups by the protrusion. Each of the large groups can be distinguished into intermediate groups by the combination of the identification protrusion. Furthermore, each of the intermediate groups can be distinguished further by the conduction member.

According to an aspect of the present invention, an image forming device includes a developing unit which is inserted in a prescribed inserting direction into the image forming device. The image forming device includes two terminals provided at the device frame, a metal conduction member, a detecting unit, a storage unit and a determination unit. The conduction member is provided on the developing unit and makes contact with at least one of the terminals. The detecting unit detects a presence or an absence of continuity between the terminals. The storage unit stores an identification flag identifying a type of image forming device and compatibility information indicating compatibility between the image forming device and the developing unit. The determination unit determines whether a detection signal from the detecting unit and the compatibility information correspond with one another when there is the identification flag.

As the conduction member, a wire rod shaped to make contact with both of the terminals or a wire rod shaped to make contact with only one of the terminals is preferable to be used.

When there is no identification flag, the determination unit is preferable to determine whether the developing unit is a developing unit for initial mounting or a developing unit for exchange in accordance with the detection signal from the detecting unit.

According to an aspect of the present invention, the image forming device stores an identification flag for identifying the type of image forming device. When there is an identification flag, as the data indicating the compatibility, the detection signal indicating the presence or the absence of the continuity of the conduction member of the developing unit is compared with the compatibility information, and the compatibility of the developing unit is determined. That is, when there is no identification flag, the detection signal from the detecting unit is used as the data indicating characteristics of the developing unit. When there is an identification flag, the detection signal of the detecting unit is used as the data indicating the compatibility. Accordingly, the detection signal from the detecting unit can be used for different purposes according to the type of developing unit. For example, as for the various types of image forming devices, in case there is a type which uses both the developing unit for initial mounting and the developing unit for exchange and a type which uses only the developing unit for initial mounting, an image forming device of the type which uses two types of developing units uses the detection signal of the detecting unit for identifying the type of developing unit. However, in case of an image forming device of the type which uses only one type of developing unit, it is not necessary to use the detection signal for such a purpose. Therefore, the detection signal from the detecting unit can be used as the data indicating the compatibility between the developing unit and the device frame. As described above, one detection signal can be used differently according to the type of image forming device. In addition, the type of image forming device can be dealt with easily by the setting of the identification flag. Therefore, the image forming device can comply flexibly with various types of developing units.

The conduction member is formed of the wire rod. By shaping the conduction member so as to make contact with both of the two terminals, a continuity state can be established reliably between the two terminals. By shaping the conduction member so as to make contact with only one of the terminals, a non-continuity state can be established reliably. In particular, since the wire rod can be shaped easily by bending, the costs can be reduced and the efficiency of the work can be improved.

DETAILED DESCRIPTION OF THE PREFERRED EMBODIMENTS

Embodiments of the present invention will be described. Further, the embodiments to be described below are preferable specific examples for implementing the present invention. Therefore, there are various technical limitations in the description. However, unless explicitly stated in the following description to limit the present invention, the present invention shall not be limited to the embodiments.

Figure 1:
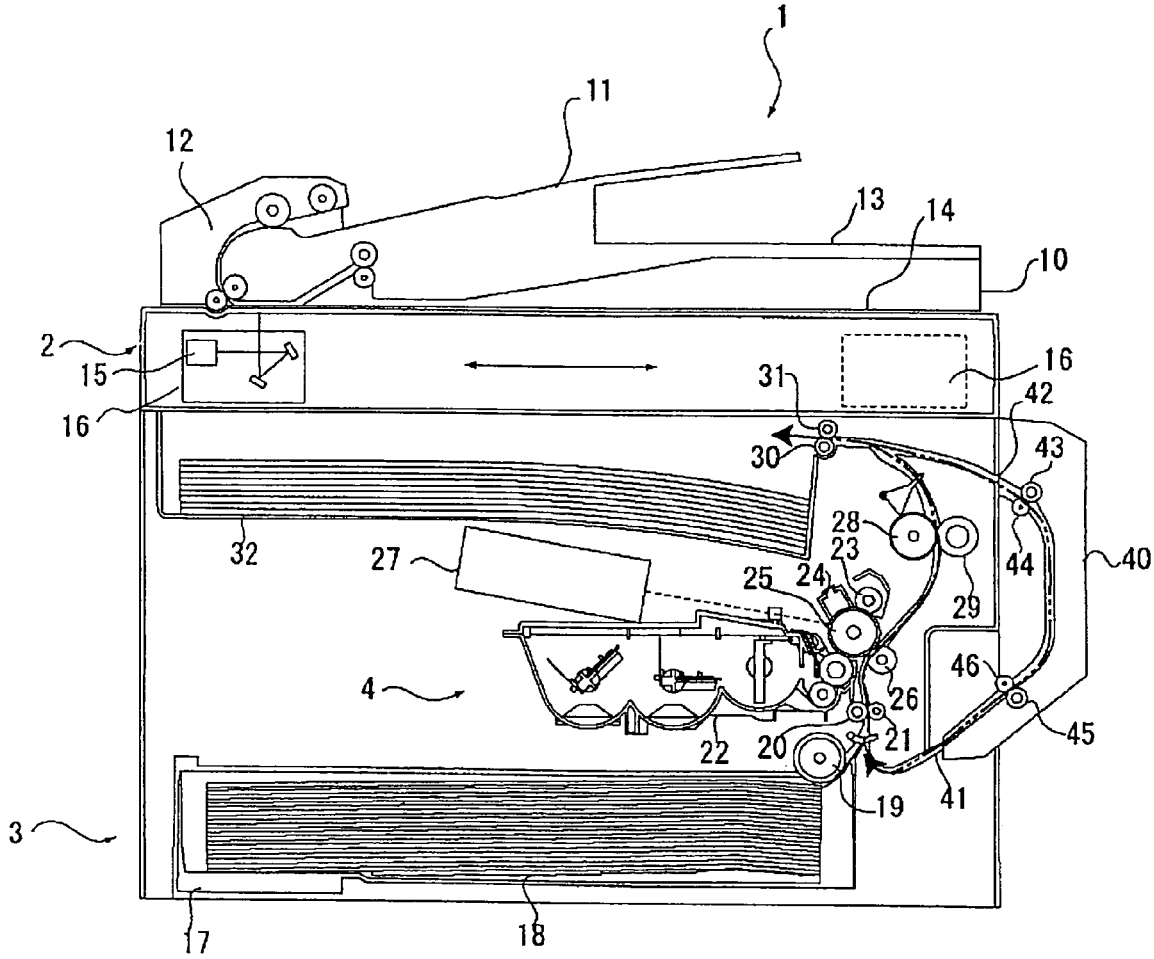
FIG. 1 is a schematic cross-sectional view of the entire image forming device according to an embodiment of the present invention.

FIG. 1 is a schematic cross-sectional view of the entire image forming device according to an embodiment of the present invention. In an upper part of an image forming device 1, a document scanning unit 2 is disposed. In a lower part of the image forming device 1, a paper feed unit 3 and a printing unit 4 are disposed in this order from a bottom surface.

In the document scanning unit 2, an original document placed on a document tray 11 is transported to a scanning position by a document transportation device 12 and discharged onto a document discharge tray 13. Further, the document tray 11 is provided on a document cover 10. A scanning device 16 is disposed to face the original document at the scanning position. The scanning device 16 includes a reading device 15 which scans an original document optically. When scanning a book or the like, the document cover 10 is swung upward and a part of the book or the like to be scanned is placed on a flatbed platen 14. Then, the scanning device 16 is moved in a direction shown with the arrow in the drawing and a scanning operation is carried out. The above-described configuration is the same as a conventional document scanning device known as an Auto Document Feeder (ADF) and a flat bed type.

In the paper feed unit 3, a paper feed cassette 17 is provided and a plurality of papers of a prescribed size are stacked on a flapper 18. A pickup roller 19 is provided at a right end of the paper feed cassette 17. The flapper 18 is urged upward by a spring member (not shown) so that an upper surface of the stacked papers makes contact with the pickup roller 19. Under this state, when the pickup roller 19 rotates, the papers are fed one sheet at a time into a paper transportation path by a frictional force.

The fed paper is transported to the printing unit 4 by a feed roller 20 and a press roller 21. For printing an image onto the transported paper, the printing unit 4 includes a developing unit 22, a paper dust removing roller 23, a corona charger 24, a photoconductive drum 25, a transfer roller 26, an exposure head 27 and a fuser roller 28.

The paper dust removing roller 23 is formed of an electrically conductive sponge or the like. The paper dust removing roller 23 traps toner or paper dust adhered on a surface of the photoconductive drum 25 after a transfer process. The corona charger 24 uniformly charges the surface of the photoconductive drum 25 by a discharge from a corotron. By exposing the photoconductive drum 25 by the exposure head 27 according to an image printing signal, an electrostatic latent image is formed on the photoconductive drum 25, which is charged uniformly by the paper dust removing roller 23 and the corona charger 24. Then, although details will be described later, the toner in the developing unit 22 is transferred onto the electrostatic latent image formed on the photoconductive drum 25, and the electrostatic latent image is visualized.

The transfer roller 26 is disposed at a position facing the photoconductive drum 25 across the paper. When a prescribed voltage is impressed to the transfer roller 26, a toner image formed on the surface of the photoconductive drum 25 is transferred onto the paper. Then, the transferred toner image is nipped and heat-pressed by the fuser roller 28 and a press roller 29 to be fixed onto the paper. The paper on which the toner image is fixed is nipped between a paper discharge roller 30 and a press roller 31 and transported out onto a paper discharge tray 32.

In FIG. 1, the paper transportation path is shown with dashed lines between the paper feed unit 3 and the paper discharge tray 32. Transportation rollers and a paper guide disposed along the paper transportation path constitute a paper transportation unit.

A reverse transportation unit 40 is attached removably at a side surface of the image forming device 1. At the side surface where the reverse transportation unit 40 is attached, a paper transportation outlet 41 and a paper transportation inlet 42 are formed. In the reverse transportation unit 40, a feed roller 43 and a press roller 44, and a feed roller 45 and a press roller 46 are disposed vertically. A reverse transportation path shown with double dashed lines in FIG. 1 is formed to diverge from the paper transportation path between the paper discharge roller 30 and the fuser roller 28, to pass between the two pairs of the transportation rollers and to converge the paper transportation path between the roller pairs 20 and 21 and the pickup roller 19.

When printing onto both sides of the paper, the paper is transported through the paper transportation path shown with the dashed lines in FIG. 1 and a printing process is executed on one side of the paper. Then, the paper is transported out onto the paper discharge tray 32 by the paper discharge roller 30. Under a state in which a trailing edge of the paper is nipped by the paper discharge roller 30 and the press roller 31, the transportation operation is stopped once. Then, the paper discharge roller 30 rotates in a reverse direction, and the paper is transported into the reverse transportation path from the trailing edge. Under a state in which the paper is nipped by the feed roller 43 and the press roller 44, the paper is transported through the reverse transportation path. Next, the paper is nipped by the feed roller 45 and the press roller 46 and transported further so that the paper makes contact with the roller pairs 20 and 21. When the paper is transported through the paper transportation path under this state, another side of the paper faces the photoconductive drum 25 and the printing process is executed on the other side of the paper. Accordingly, both sides of the paper are printed.

Figure 2:
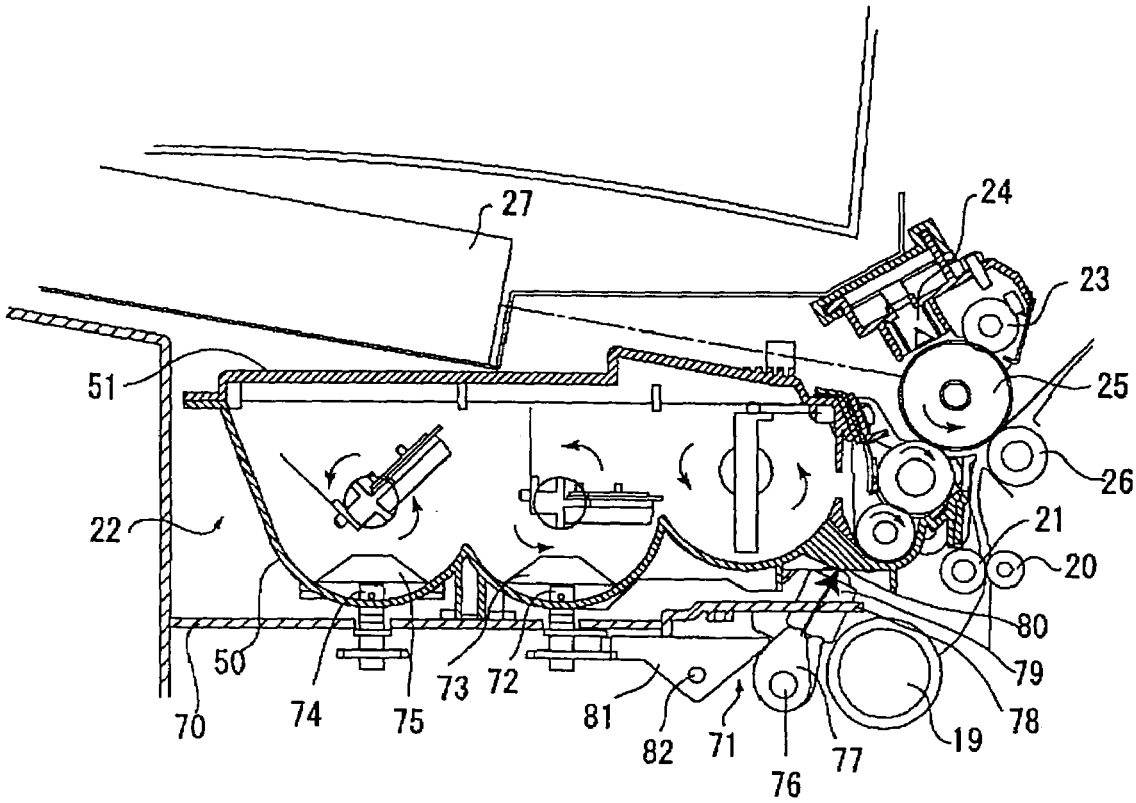
FIG. 2 is an enlarged cross-sectional view of a printing unit.
Figure 3:
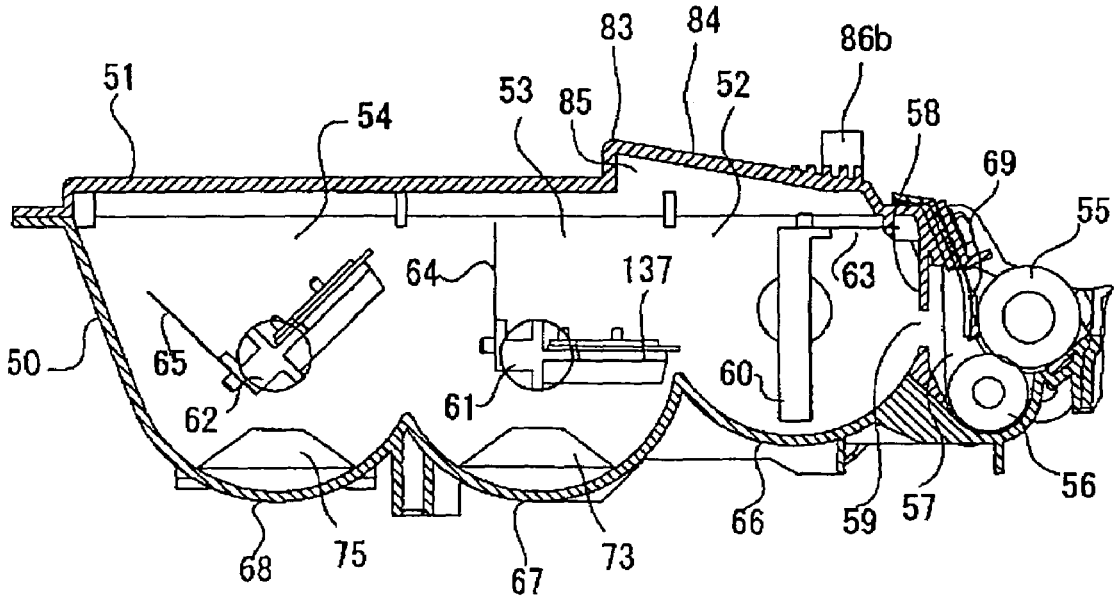
FIG. 3 is an enlarged cross-sectional view of a developing unit.
Figure 4:
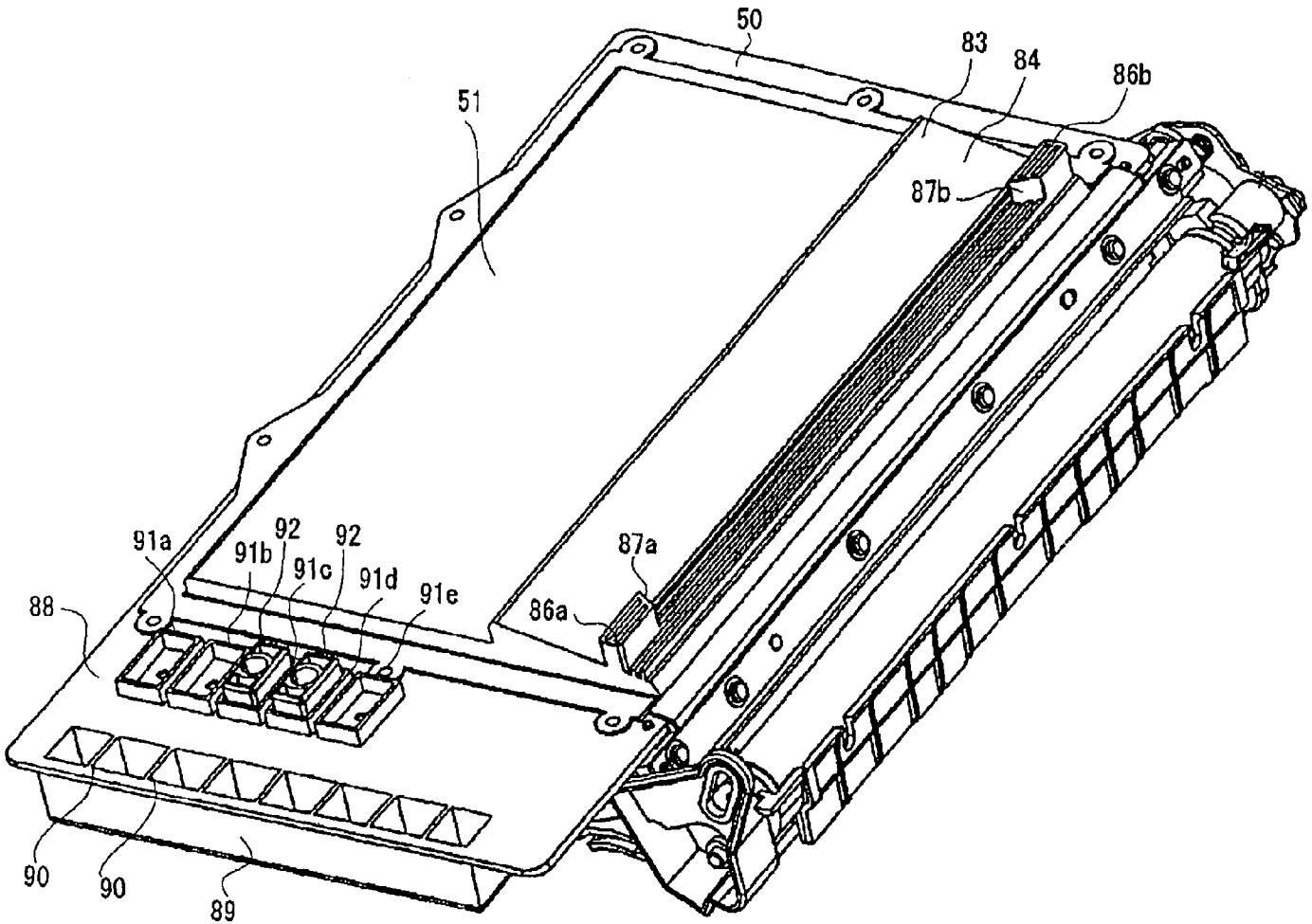
FIG. 4 is an exterior perspective view of the entire developing unit.

FIG. 2 is an enlarged cross-sectional view of the printing unit 3 of FIG. 1. FIG. 3 is an enlarged cross-sectional view of the developing unit 22. FIG. 4 is a perspective view showing the developing unit 22 viewed from an upper side.

As described above, the developing unit 22, the paper dust removing roller 23, the corona charger 24 and the transfer roller 26 are disposed around the photoconductive drum 25. Between the corona charger 24 and the developing unit 22, a laser light from the exposure head 27 is irradiated on the surface of the photoconductive drum 25 according to the image printing signal.

The developing unit 22 is formed by fixing a cover 51 on an upper part of a container 50 by welding or with a screw and by sealing the container 50. Three toner chambers 52, 53 and 54 are formed as toner replenish chambers in the container 50. At a region of the container 50 located on the photoconductive drum 25, a supply chamber 57 having a developing roller 55 and a supply roller 56 is formed. The first toner chamber 52 and the supply chamber 57 are partitioned by a partition plate 58 that extends downward from a lower surface of the cover 51. A replenish opening 59 is formed through the partition plate 58.

As shown in FIG. 3, the three toner chambers 52, 53 and 54 are disposed to be in parallel with one another in a horizontal direction under a state in which the developing unit 22 is inserted in the image forming device 1. At approximately the center part of each of the toner chambers, paddles 60, 61 and 62 are respectively provided as a means for agitating and transferring. Suppose that a perpendicular direction of the page of FIG. 2 is in a front-back direction of the developing unit 22. Then, both end parts of a rotational shaft of each of the paddles in the front-back direction are supported by front and back frames of the container 50. The rotational shafts are aligned in the front-back direction. At a tip end of the paddle 60, a blade 63 made of a flexible resin film is attached along a rotational direction of the paddle 60. In the same manner, a blade 64 is attached to the paddle 61 and a blade 65 is attached to the paddle 62. A common member is used for the blades 63, 64 and 65. Sliding surfaces 66, 67 and 68 are formed on a bottom surface of the container 50. The sliding surfaces 66, 67 and 68 are curved outward to have an arc-shape in cross-section so as to follow along a path of rotational movements of the blades attached to the paddles.

The toner replenished in each of the toner chambers 52, 53 and 54 is accumulated on the sliding surfaces 66, 67 and 68. When the paddles 60, 61 and 62 are rotated, the blades 63, 64 and 65 are rotated to slide against the sliding surfaces 66, 67 and 68, respectively. By the sliding movement of each of the blades, the toner is scooped and the toner is agitated in each of the toner chambers. As a result, the deterioration of the toner due to aggregation of the toner can be prevented. Moreover, as shown in FIG. 2, when the blades 63, 64 and 65 are rotated counterclockwise, the toner in the third toner chamber 54 is transferred into the second toner chamber 53, and the toner in the second toner chamber 53 is transferred into the first toner chamber 52. Then, the toner in the first toner chamber 52 is replenished into the supply chamber 57 through the replenish opening 59 of the partition plate 58. At this time, the replenished toner is agitated by the paddle 60 in the first toner chamber 52 and a preliminary charging is carried out. The replenish opening 59 is opened as a slit in the front-back direction. By adjusting the width and the position of the opening, the amount of the toner replenished from the first toner chamber 52 into the supply chamber 57 can be adjusted.

While the supply roller 56 is rotated, the supply roller 56 is rubbed against the developing roller 55, and the toner replenished into the supply chamber 57 is rubbed and charged. Then, the toner is carried on the surface of the developing roller 55. A developing blade 69 is disposed in proximity to or in contact with the surface of the developing roller 55. The developing blade 69 controls the layer thickness of the supplied toner. By the developing roller 55 and the photoconductive drum 25 being rubbed against one another while rotating, the toner layer controlled to have a prescribed layer thickness by the developing blade 69 is adhered onto the electrostatic latent image formed on the surface of the photoconductive drum 25, and the electrostatic latent image is developed.

The developing unit 22 can be inserted or removed with respect to the image forming device 1 in the front-back direction. In FIG. 2, it is defined that a front side in the perpendicular direction of the page is a front side of the developing unit 22 and the opposite is a rear side of the developing unit 22. The developing unit 22 is inserted from the rear side into an installation space formed in a main frame 70 of the image forming device 1. A pressing mechanism 71 is provided on the main frame 70 of the image forming device 1. The container 50 is pushed upward from a lower side by the pressing mechanism 71. Then, the developing unit 22 is set to the main frame 70 so that the developing roller 55 makes contact with the photoconductive drum 25. In response to the pressing movement of the pressing mechanism 71, a remaining toner detecting sensor 72 is elevated and set in a concave groove 73. Further, the concave groove 73 is formed of a transparent member and provided on the sliding surface 67. In the same manner, in response to the inserting movement of the developing unit 22, a remaining toner detecting sensor 74 is elevated and set in a concave groove 75. Further, the concave groove 75 is formed of a transparent member and provided on the sliding surface 68.

In the pressing mechanism 71, a bottom surface of a pressing body 79 provided slidable on a plate 78 makes contact with a cam member 77 fixed on a rotational shaft 76. When the developing unit 22 is inserted, an upper surface of the pressing body 79 faces a rib-shaped contact portion 80 formed on the bottom surface of the developing unit 22. When an operator swings a lever (not shown) fixed on an end part of the rotational shaft 76, the cam member 77 rotates clockwise and pushes the pressing body 79 upward in the direction of the arrow. Then, the pressing body 79 presses the contact portion 80 and the developing roller 55 makes contact with the photoconductive drum 25.

The remaining toner detecting sensor 72 is fixed on one end part of a swing lever 81. Another end part of the swing lever 81 is urged downward by a compressing spring (not shown) so as to make contact with the cam member 77. When the cam member 77 rotates clockwise, the swing lever 81 rotates clockwise with a shaft 82 as the center and the remaining toner detecting sensor 72 is elevated. The remaining toner detecting sensor 74 can be elevated in response to the pressing movement of the pressing mechanism 71 in the same manner.

As shown in FIG. 4, the cover 51 of the developing unit 22 is formed in a plate-shape so as to seal the upper opening of the container 50. On the cover 51, a leveled part 83 protruding upward is provided at a position located off centered, towards the developing roller 55. A slanting part 84 slanting downward from the leveled part 83 toward the developing roller 55 is also formed on the cover 51. The leveled part 83 is formed from a front edge toward a rear edge of the cover 51 along the inserting direction of the developing unit 22.

As shown in FIG. 3, an inner surface of the cover 51 is formed to spread upward from the leveled part 83 to the slanting part 84 to form a space 85. Guide protrusions 86*a* and 86*b* protruding upward are formed on an end part of the slanting part 84 located above the developing roller 55. The guide protrusions 86*a* and 86*b* are arranged in the inserting direction of the developing unit 22 on a part of the cover 51 located above the developing roller 55. The guide protrusion 86*a* is disposed at a rear side of the inserting direction. The guide protrusion 86*b* is disposed at a front side of the inserting direction. An interval between the guide protrusion 86*a* and the developing roller 55 is set slightly larger than an interval between the guide protrusion 86*b* and the developing roller 55. A cavity is formed inside the guide protrusions 86*a* and 86*b*. Ribs are formed at a center part of the cavity along the inserting direction. Between the guide protrusions 86*a* and 86*b*, a plurality of ribs are formed along the inserting direction. Side surfaces 87*a* and 87*b* of the guide protrusions 86*a* and 86*b* facing one another are slanted to widen toward the developing roller 55 according to an irradiating range of the laser light irradiated by the exposure head 27 shown in FIG. 2.

As shown in FIG. 4, a flat plate 88 extends in a horizontal direction at the front side of the container 50. A grasping part 89 is formed downward on a lower surface of the flat plate 88. The grasping part 89 is a rectangular parallelepiped having an upper opening. A plurality of reinforcement ribs 90 are provided in the front-back direction in a gap inside the grasping part 89. On an upper surface of the flat plate 88, rectangular frame-shaped attaching portions 91*a* through 91*e* are arranged in a direction approximately orthogonal to the inserting direction of the developing unit 22. Identification protrusions 92 are fit and fixed in the attaching portions 91*a* through 91*e*. The identification protrusions 92 identify compatibility of the developing unit 22 and the device frame. The identification protrusions 92 are fixed in the attaching portions 91 selected according to a type of developing unit. Therefore, when there is no compatibility between the positions of the identification protrusions 92 and the device frame, the developing unit cannot be inserted.

Figure 5:
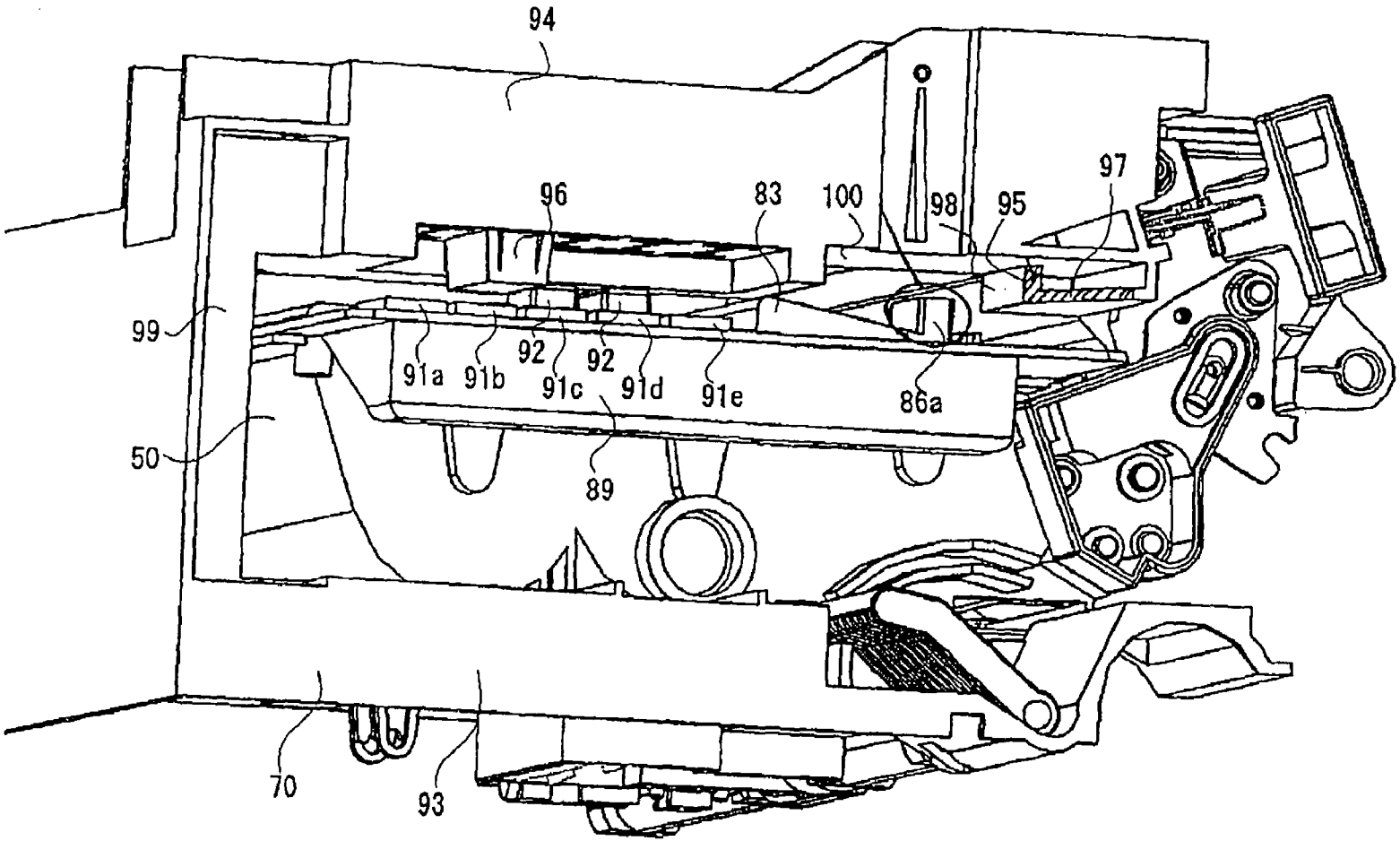
FIG. 5 is a perspective view of a state in which the developing unit is inserted in a main frame viewed from a front side.

FIG. 5 is a perspective view showing a state in which the developing unit 22 is inserted in the main frame 70. A space for inserting the developing unit 22 is provided between a bottom surface part 93 and an upper surface part 94 of the main frame 70. The height of the guide protrusions 86*a* and 86*b* is set so that when the developing unit 22 is inserted, a slight gap is formed between the developing unit 22 and a lower surface of the upper surface part 94. Accordingly, the developing unit 22 is prevented from moving vertically when inserting or removing the developing unit 22.

On the lower surface of the upper surface part 94, a regulatory member 95 and an identification engaging portion 96 are formed protruding downward along an edge of a front opening at the front side of the page of FIG. 5. A guide surface 97 slanted in the inserting direction is formed on the regulatory member 95 at the front opening. A regulatory surface 98 located on the opposite side of the photoconductive drum 25 is positioned so that the developing unit 22 is inserted apart from the photoconductive drum 25. When the guide protrusion 86*a* or 86*b* reaches a position regulated by the regulatory surface 98, since there is only a slight gap between the side surface of the developing unit 22 and a side surface 99 of the main frame 70, the developing unit 22 is inserted and removed without being moved to the left or the right.

The identification engaging portion 96 can be fixed at five attaching positions corresponding to the attaching portions 91*a* through 91*e*. The position of the identification engaging portion 96 has consistency with the positions of the identification protrusions 92 protruding from the developing unit 22 which can be inserted into the device frame and which has compatibility. Accordingly, when the developing unit 22 is inserted, the identification protrusions 92 and the identification engaging portion 96 do not collide with one another. When a developing unit not having compatibility with the device frame is inserted, the identification protrusions 92 and the identification engaging portion 96 collide with one another. However, as described above, there is only a slight gap between the side surface of the developing unit 22 and the side surface 99 of the main frame 70. Therefore, the identification protrusions 92 and the identification engaging portion 96 cannot be prevented from colliding with one another by displacing the developing unit 22 to the left or to the right. As a result, a developing unit not having compatibility cannot be inserted.

Figure 6A:
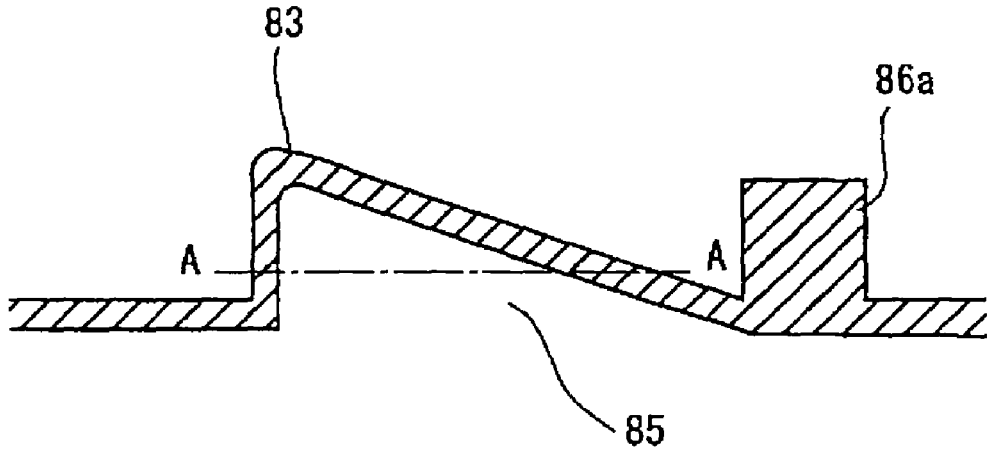
FIG. 6A and FIG. 6B are views for describing when a leveled part of the developing unit is cut off.
Figure 6B:
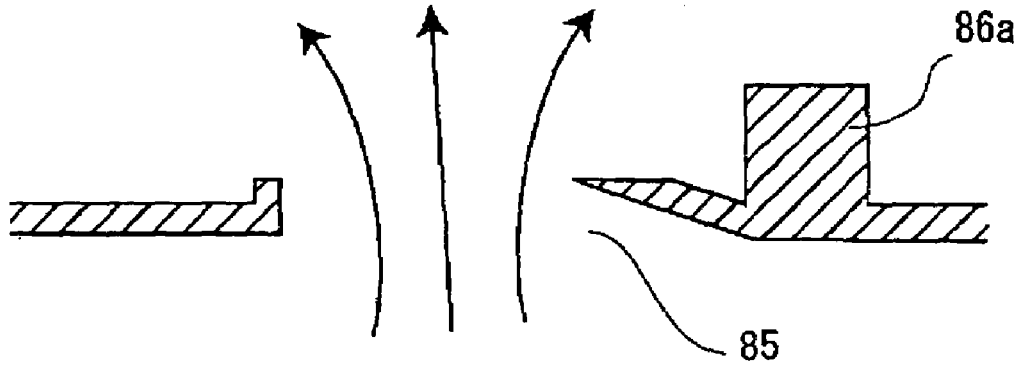

In the above-described example, the leveled part 83 is formed on the cover 50 of the developing unit 22. According to the presence or the absence of the leveled part 83, the compatibility of the developing unit 22 can be provided. That is, in FIG. 5, a gap 100 for permitting the leveled part 83 to pass through is formed between the attached position of the identification engaging portion 96 and the position of the restriction member 95. Therefore, when inserting a developing unit having the leveled part 83 larger than the gap 100, the leveled part 83 collides with the device frame and the developing unit fails to be inserted. When inserting the developing unit forcibly by cutting off the leveled part 83, for example, when the leveled part 83 is cut off at cutting lines A—A as shown in FIG. 6A, an opening is formed through the developing unit and the gap 85, and the inner side of the developing unit is connected to the outside as shown in FIG. 6B. The toner spouts out from the opening and the developing unit becomes incapable of being used.

As described above, to ensure the compatibility between the developing unit and the device frame, a physical device such as (1) the combinations of the identification protrusions 92 fixed on the attaching portions 91*a* through 91*e* of the developing unit and (2) the presence or the absence of the leveled part 83 of the developing unit are used.

For identifying the compatibility between the developing unit and the device frame, an electrical device can also be used. First, a structure of an electrical connection between the developing unit 22 and the device frame when inserting the developing unit 22 will be described.

Figure 7:
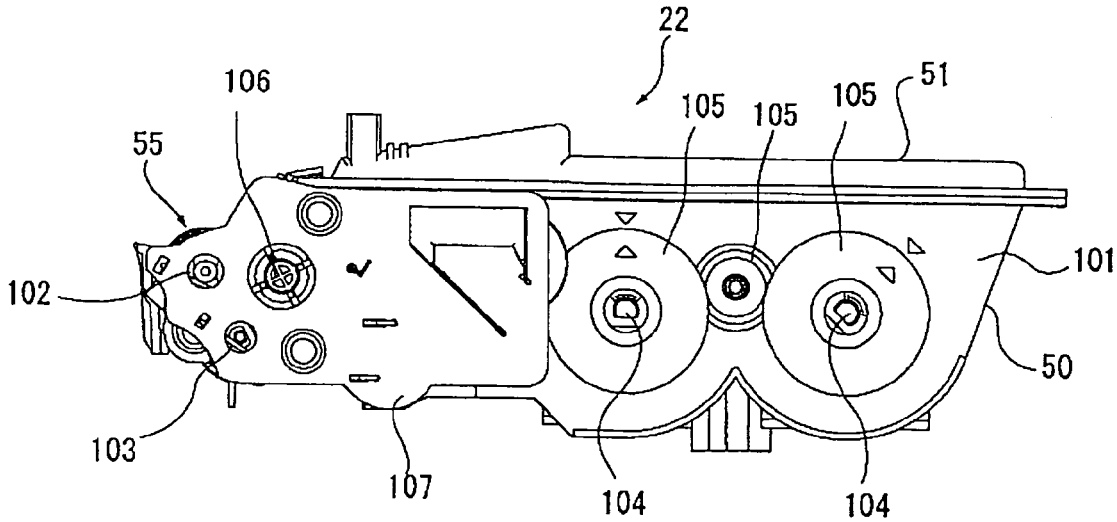
FIG. 7 is an exterior view showing a rear part of the developing unit.

FIG. 7 is an exterior view showing a rear side of the developing unit 22. On a rear frame 101 of the container 50, a rotational shaft 102 of the developing roller 55, a rotational shaft 103 of the supply roller 56 and rotational shafts 104 of the paddles 60 through 62 are supported rotatably, respectively. An end part of each of the rotational shafts 102, 103 and 60–62 protrudes outward from the rear frame 101. Gears 105 for transmitting a drive force are mounted on the protrusions. When the developing unit 22 is inserted, a drive shaft 106 is connected to a drive mechanism of the device frame. A drive force from the drive shaft 106 is transmitted to each of the rotational shafts by the transmitting gears. A cover member 107 is attached to the rear frame 101. The cover member 107 covers a part of the rear frame 101 located at the developing roller 55 including the rotational shafts 102 and 103.

Figure 8:
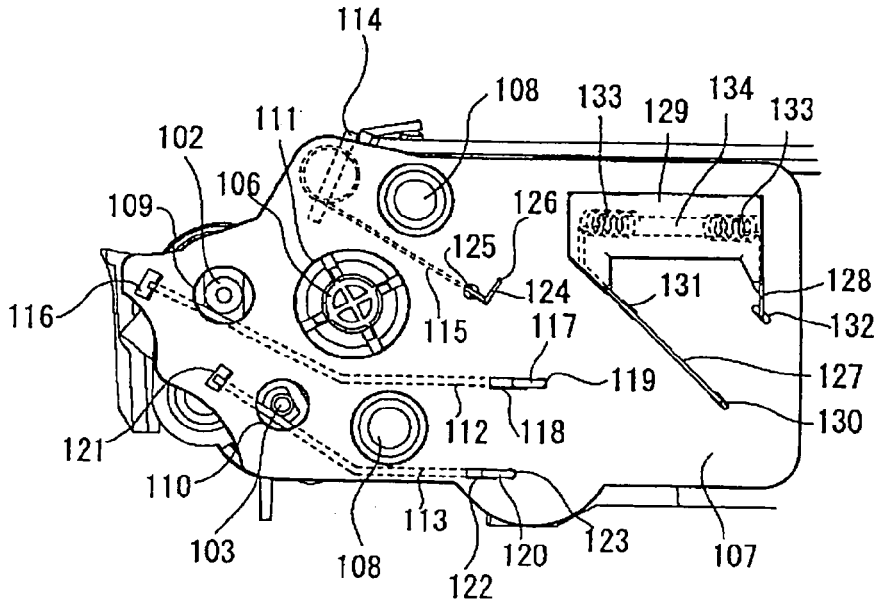
FIG. 8 is an enlarged view showing a structure of an electrical connection of the developing unit.

FIG. 8 is an enlarged view of the cover member 107 attached on the rear side of the developing unit 22. Mounting holes 108*a* and 108*b* are formed on the cover member 107 for screwing the cover member 107 onto the rear frame 101. Circular openings 109, 110 and 111 are formed through the cover member 107 at positions corresponding to the rotational shaft 103 of the-supply roller 56 and the drive shaft 106, respectively. On the reverse side of the cover member 107, a first contact member 112, a second contact member 113 and a third contact member 115 are mounted. The first contact member 112 makes contact with the rotational shaft 102 of the developing roller 55. The second contact member 113 makes contact with the rotational shaft 103 of the supply roller 56. The third contact member 113 makes contact with the pressing plate 114 of a blade which makes contact with the surface of the developing roller 55.

The first contact member 112 is a metal wire rod formed in a hook shape by being bent once at the center part. One end of the first contact member 112 is inserted and held at a holder 116 of the cover member 107. The holder 116 is formed to protrude toward the reverse side of the cover member 107 with a height difference. The holder 116 has an opening for inserting the first contact member 112 into the holder 116. Another end of the first contact member 112 is bent twice into a shape of a bracket to form a contact portion 117. The contact portion 117 is engaged and fixed in a narrow inserting hole 118 and a circular engaging hole 119 formed through the cover member 107.

When mounting the contact portion 117 onto the cover member 107, first, the contact portion 117 is inserted into the inserting hole 118 from the reverse side and protrudes to the front side. Then, the bent tip end of the first contact member 112 is inserted into the engaging hole 119. By mounting the contact portion 117 as described above, the contact portion 117 is set under a state protruding from the front side of the cover member 107. The contact portion 117 reliably makes contact with an electrode of the image forming device 1, and can be connected electrically with the image forming device 1. Since a diameter of the engaging hole 119 is formed approximately the same as the diameter of the first contact member 112, the other end of the first contact member 112 is fixed tightly. Furthermore, the one end of the first contact member 112 is held by the holder 116. Therefore, the first contact member 112 is not displaced from the cover member 107. The first contact member 112 is contacted against the rotational shaft 102 by an elastic force which urges the first contact member 112 upward. The first contact member 112 and the rotational shaft 102 are maintained under a stable contacting state and the electrical contacting state can be established reliably.

The second contact member 113 is also made of a metal wire rod formed in a hook shape by being bent once like the first contact member 112. Another end of the second contact member 113 is bent twice to form a contact portion 120 having a shape of a bracket. One end of the second contact member 113 is inserted and held at a holder 121 provided in the same manner as the holder 116. In the same manner as the contact portion 117, the contact portion 120 is engaged and fixed in a narrow inserting hole 122 and a circular engaging hole 123 provided on the cover member 107. Therefore, the second contact member 113 is held reliably without being displaced from the cover member 107. In addition, the contact portion 120 is set under a state protruding from the front side of the cover member 107. The second contact member 113 reliably makes contact with the electrode of the image forming device 1 and can be connected electrically. The second contact member 113 is contacted against the rotational shaft 103 by an elastic force which urges the second contact member 113 upward. In the same manner as the first contact member 112, the second contact member 113 and the rotational shaft 103 are maintained under a stable contacting state and the electrical contacting state can be established reliably.

The third contact member 115 is made of a metal wire rod having a small diameter. One end of the third contact member 115 is formed in a shape of a coil spring. Another end of the third contact member 115 is bent perpendicularly in the shape of the letter L to form a contact portion 124. A tip end of the contact portion 124 is bent further into a hook shape. When mounting the third contact member 115 onto the cover member 107, the other end of the third contact member 115 is inserted from the reverse side into a circular inserting hole 125 formed on the cover member 107. The contact portion 124 is exposed on the front side of the cover member 107. The bent part at the tip end is inserted and fixed in a circular engaging hole 126.

The diameter of the engaging hole 126 is formed approximately the same as the diameter of the third contact member 115. Therefore, the other end of the third contact member 115 is held reliably without being displaced from the cover member 107. The contact portion 124 is set under a state protruding from the front side of the cover member 107. The third contact member 115 reliably makes contact with the electrode of the image forming device 1 and can be connected electrically. Moreover, when mounting the cover member 107 onto the rear frame 101, the part of the one end formed in the shape of the coil spring makes contact with the edge of the pressing plate 114 of the blade and is maintained under a compressed state. Therefore, the third contact member 115 and the pressing plate 114 can be maintained under a stable contacting state and the electrical contacting state can be established reliably.

A fourth contact member 127 and a fifth contact member 128 for identifying the developing unit 22 are provided on the cover member 107. The fourth contact member 127 is a metal wire rod having a small diameter. One end of the fourth contact member 127 is bent in a hook shape and inserted toward the reverse side of a protector 129 mounted removably on the cover member 107. A center part of the fourth contact member 127 is exposed on the front side of the cover member 107. Another end of the fourth contact member 127 is bent and inserted on the reverse side of the cover member 107 via a narrow inserting hole 130 formed on the cover member 107. An inserting hole 131 like the inserting hole 130 is formed on the cover member 107. When the length of the fourth contact member 127 is short, the other end of the fourth contact member 127 is inserted into the inserting hole 131.

The fifth contact member 128 is made of a metal wire rod having a small diameter. In the same manner as the fourth contact member 127, one end of the fifth contact member 128 is bent in a hook shape and inserted toward the reverse side of the protector 129. Another end of the fifth contact member 128 is bent and inserted on the reverse side of the cover member 107 via a narrow inserting hole 132 formed on the cover member 107.

The end of the fourth contact member 127 bent in the hook shape is disposed facing the bent end of the fifth contact member 128. Metal coil springs 133 are set on both ends. A fuse member 134 is held between the two coil springs 133.

Figure 9:
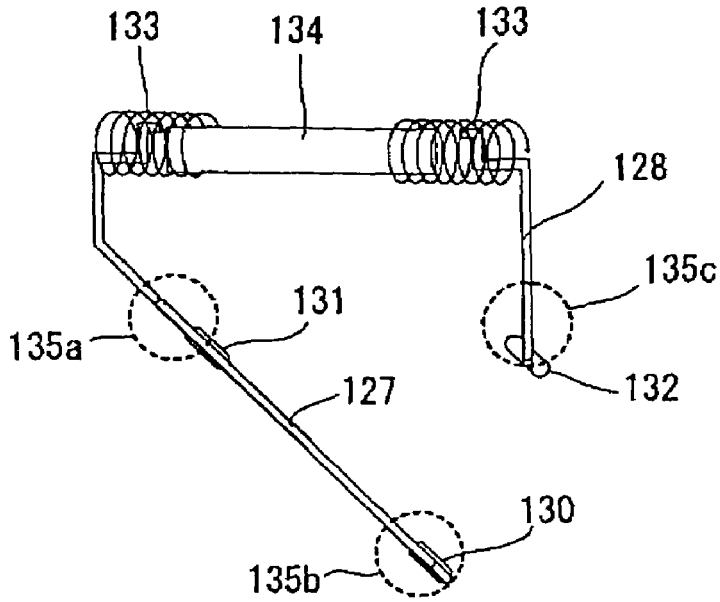
FIG. 9 is an enlarged view showing a part for carrying out an electrical identification and detection.

As shown in FIG. 9, when the developing unit 22 is inserted into the device frame, two connection terminals 135*a* and 135*b* of the device frame make contact with the fourth contact member 127. The connection terminal 135*a* is disposed so as to make contact with the fourth contact member 127 in proximity to the inserting hole 131. The connection terminal 135*b* is disposed so as to make contact with the fourth contact member 127 in proximity to the inserting hole 130. When the fourth contact member 127 has a length to reach the inserting hole 130, both of the connections terminals 135*a* and 135*b* make contact with the fourth contact member 127. However, when the fourth contact member 127 has a short length to reach just the inserting hole 131, only the connection terminal 135*a* makes contact with the fourth contact member 127. A connection terminal 135*c* of the device frame makes contact with the fifth contact member 128 in proximity to the inserting hole 132.

Figure 10:
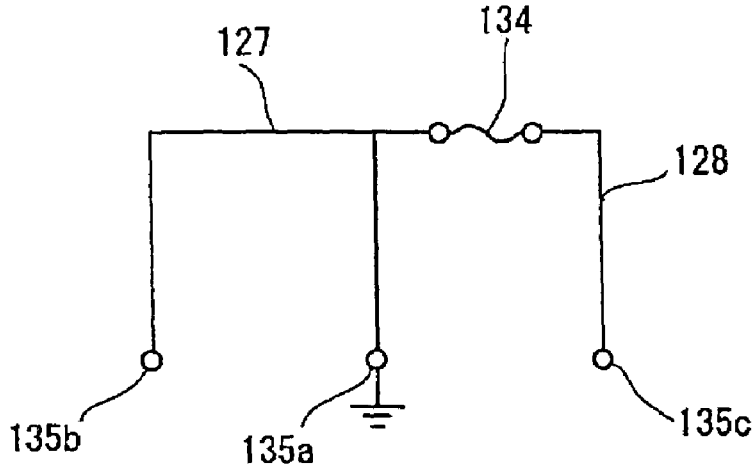
FIG. 10 is a circuit diagram of FIG. 9.

FIG. 10 is a circuit diagram showing a state in which the developing unit 22 is inserted into the device frame and makes contact with the connection terminals of the device frame. The connection terminal 135*a* is set at a ground potential, and the presence or the absence of continuity between the connection terminals 135*a* and 135*b* is detected. When the continuity is detected, the fourth contact member 127 is identified to have a length to reach the inserting hole 130. When the continuity is not detected, the fourth contact member 127 is identified to have a length to reach the inserting hole 131. Therefore, by changing the length of the fourth contact member 127 according to the type of the developing unit 22, the type of the developing unit 22 can be identified. By applying an electric current between the connection terminals 135*a* and 135*c* sufficient for blowing out the fuse member 134, the fuse member 134 is cut when the developing unit 22 is inserted. Therefore, a developing unit, which has been inserted into the device frame even for once, cannot bring the connection terminals 135*a* and 135*c* into conduction. Thus, by detecting the presence or the absence of the continuity between the connection terminals 135*a* and 135*c*, the developing unit 22 can be identified to be new or used.

As described above, as the electric device for identifying the developing unit at the device frame, there are (3) the detection of the presence or the absence of the continuity between the connection terminals 135*a* and 135*b*, and (4) the detection of the presence or the absence of the continuity between the connection terminals 135*a* and 135*c*.

Next, the structure of the remaining toner detecting sensors 72 and 74 will be described. As shown in FIG. 2, when the developing unit 22 is inserted, the remaining toner detecting sensors 72 and 74 are set in the concave grooves 73 and 75 formed on the bottom surface of the replenish chambers of the developing unit 22, respectively. The mechanisms of the remaining toner detecting sensors 72 and 74 are the same mechanism. Therefore, the mechanism of the remaining toner detecting sensor 72 will be described, and a description of the mechanism of the remaining toner detecting sensor 74 will be omitted.

Figure 11:
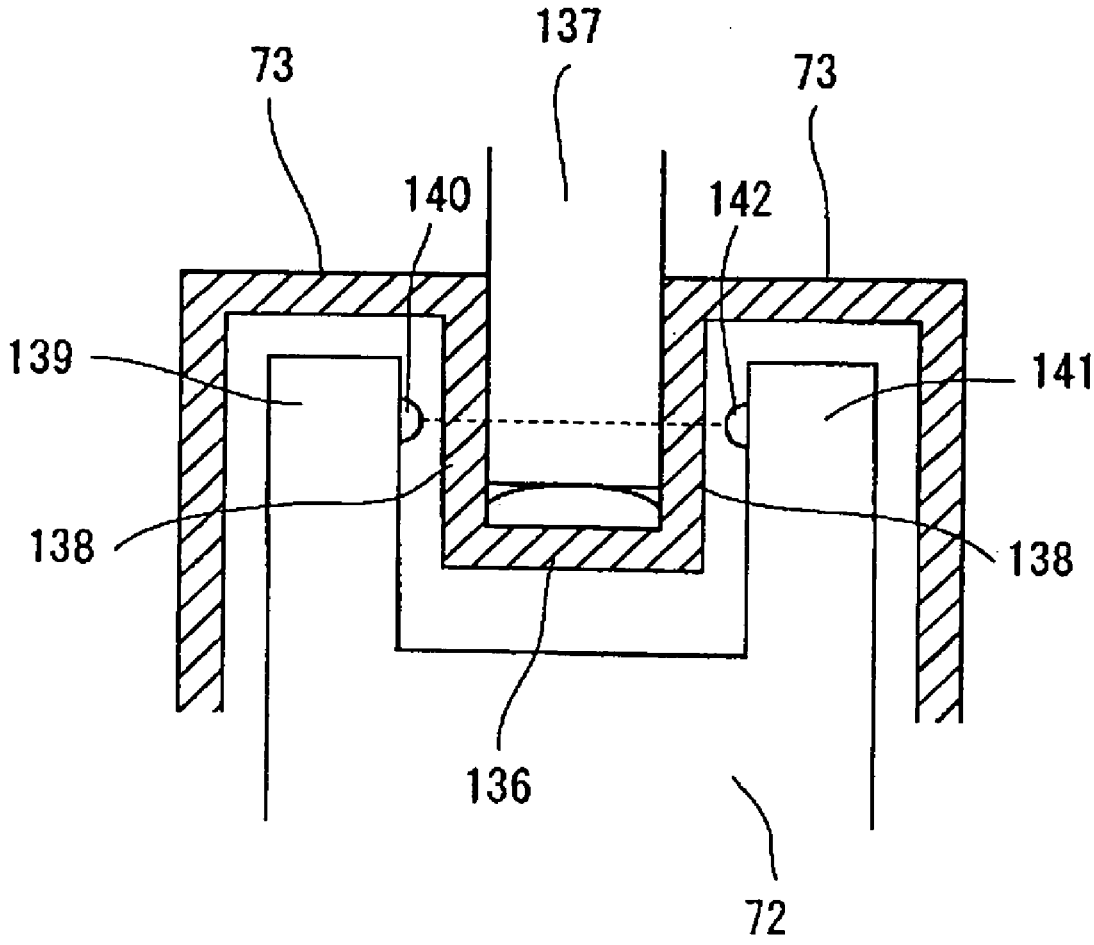
FIG. 11 shows a detection operation of a remaining toner detecting sensor.

FIG. 11 is a cross-sectional view showing the state in which the center part of the concave groove 73 is cut in the vertical direction orthogonal to the page of FIG. 2. Two concave grooves 73 are provided at both sides of a remaining amount detecting unit 136. The concave grooves 73 and the remaining amount detecting unit 136 are formed integrally by a transparent member made of synthetic resin. As shown in FIG. 2, the remaining amount detecting unit 136 having a prescribed groove width is formed along a rotational track of a cleaning member 137 mounted on the paddle 61. The toner in the remaining amount detecting unit 136 is discharged once to the outside of the remaining amount detecting unit 136 each time the cleaning member 137 slides inside the remaining amount detecting unit 136. The cleaning member 137 is formed of a plurality of rectangular rubber sheets stacked one on the other. The width of each sheet is slightly larger than the groove width of the remaining amount detecting unit 136. The rubber sheets are mounted on surfaces orthogonal to the direction in which the cleaning member 137 proceeds. Therefore, the sheets of the cleaning member 137 slide in a close contact against both sides 138 of the remaining amount detecting unit 136 at all times, and the toner is removed once. Meanwhile, in the remaining toner detecting sensor 72, a light emitter 140 is fixed on a protrusion 139 set in one of the concave grooves 73. A light receiver 142 is fixed on a protrusion 141 set in the other concave groove 73. The light receiver 142 outputs a detection signal according to whether or not the light receiver 142 receives the light from the light emitter 141 that penetrates through the remaining amount detecting unit 136.

Each time the cleaning member 137 slides inside the remaining amount detecting unit 136 in synchronism with the rotation of the paddle 61, the light from the light emitter 140 penetrates through the remaining amount detecting unit 136 and the light receiver 142 outputs the detection signal. When a sufficient amount of toner is accumulated in the replenish chamber, after the cleaning member 137 slides, the inner part of the remaining amount detecting unit 136 is filled in with the toner again. Therefore, the light receiver 142 does not detect the light from the light emitter 140. However, when the remaining amount of the toner in the replenish chamber becomes small, the inner part of the remaining amount detecting unit 136 cannot be filled in with the toner. Accordingly, the light receiver 142 continues to detect the light. In accordance with such a change in the detection signal, the remaining toner detecting sensor 72 transmits to a control unit of the image forming device, a detection signal indicating the remaining amount of toner.

As a method for detecting the remaining amount of the toner, other than the detection signal indicating the detection of the light by the light receiver 142, a timing signal indicating the rotation of the paddle 61 can be considered. For example, a period of time from when the cleaning member 137 passes the remaining amount detecting unit 136 until the light receiver 142 no longer detects the light can be detected. In addition, a correlation between the detected period of time and the remaining amount of the toner can be tested and determined in advance. Then, in accordance with the correlation, the remaining amount of the toner can be detected. Moreover, a number of times the light from the light emitter 140 is shielded by the toner can be counted by the presence or the absence of the detection signal indicating the detection of the light by the light receiver 142. The counted number of times the toner is agitated can be used as an index for indicating the degree of deterioration of the toner.

The remaining toner detecting sensor 74 detects the remaining amount of the toner in a toner chamber 54 located farthest away from the supply chamber 57. The remaining toner detecting sensor 72 detects the remaining amount of the toner in a toner chamber 53 located second farthest away from the supply chamber 57. Therefore, the remaining amount of the toner can be detected even under a state in which the toner remains to some extent. That is, the toner is transferred sequentially to the supply chamber by the paddles. Therefore, the remaining amount of the toner becomes larger in the toner chamber 52 than in the toner chamber 54 located farthest away from the supply chamber 57. Thus, by detecting the change in the remaining amount of the toner in the toner chambers 54 and 53 in which the change in the toner amount is most likely to generate, the state of the remaining toner in the developing unit 22 can be grasped accurately.

Figure 12:
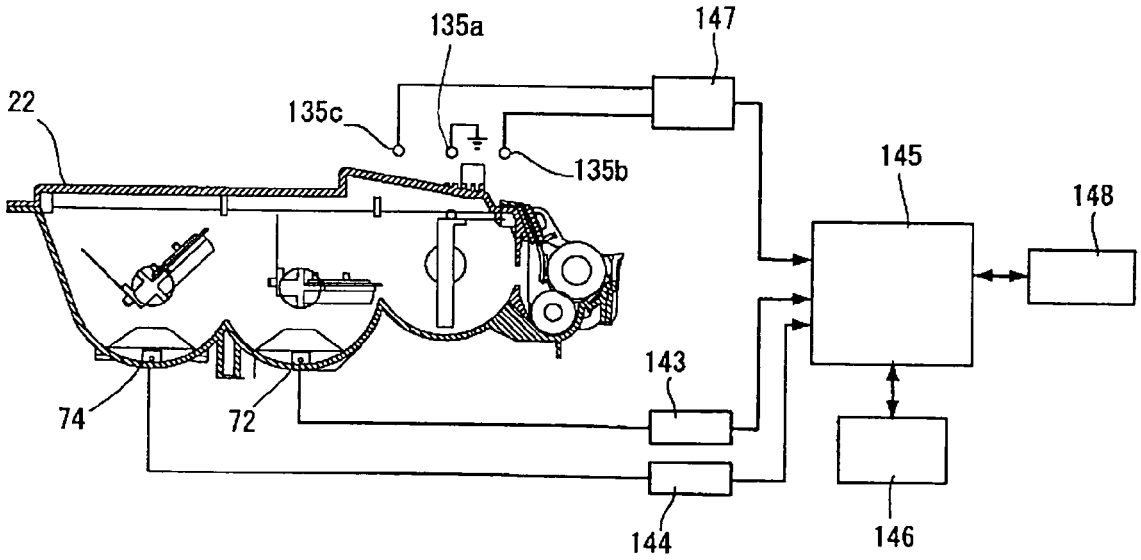
FIG. 12 shows a circuitry for carrying out an electrical detection of the developing unit.

Therefore, according to the state of the remaining toner in the developing unit 22, a time to replace the developing unit 22 can be notified. FIG. 12 shows an example of such circuitry. The detection signals from the remaining toner detecting sensors 72 and 74 are input via detecting circuits 143 and 144 to a control circuit 145. A storage circuit 146 stores in advance, data indicating a correlation between a detection pattern of the presence or the absence of the toner from the remaining toner detecting sensors 72 and 74, and the state of the remaining toner in the developing unit 22. The control circuit 145 retrieves the correlation data from the storage circuit 146. Then, the control circuit 145 compares the correlation data with the input data from the detecting circuits 143 and 144 and monitors the state of the remaining toner in the developing unit 22. Meanwhile, the detection signals relating to the presence or the absence of the continuity between the connection terminals 135*a* and 135*b* and the presence or the absence of the continuity between the connection terminals 135*a* and 135*c* are input from the detecting circuit 147 into the control circuit 145.

When detecting the presence or the absence of the continuity between the connection terminals 135*a* and 135*c*, the control circuit 145 detects whether or not both of the terminals are energized and brought into conduction. When there is continuity, the control circuit 145 determines that a new developing unit has been inserted and the process proceeds onto a subsequent process. Then, an electric current sufficient for the fuse member 134 to be blown out is supplied, and both of, the terminals are brought into a non-continuity state. When there is no continuity between the terminals, the control circuit 145 determines that a used developing unit has been inserted and the process does not proceed onto a subsequent process. For example, the control circuit 145 controls to display an error on a display circuit 148.

Among new developing units, when comparing a developing unit for initial mounting inserted initially into the image forming device and a developing unit for exchange inserted after removing the developing unit for initial mounting, the amount of the toner filled in the developing unit is set larger in the developing unit for exchange than in the developing unit for initial mounting. Therefore, as shown in the above (3), by using the fact that the presence or the absence of the continuity state between the connection terminals 135*a* and 135*b* is determined by the length of the fourth connection member 127, a setting can be made in advance that when the fourth connection member 127 is long (when there is continuity), the inserted developing unit is a developing unit for initial mounting, and when the fourth connection member 127 is short (when there is no continuity), the inserted developing unit is a developing unit for exchange. Therefore, when the developing unit is inserted, in accordance with the detection data regarding the presence or the absence of the continuity state between the connection terminals 135*a* and 135*b*, a determination is made as to whether the inserted developing unit is a developing unit for initial mounting or a developing unit for exchange.

The storage circuit 146 stores in advance, data regarding a remaining state of the toner when the developing unit for initial mounting and the developing unit for exchange are necessary to be replaced. The control circuit 145 fetches data of the remaining state of the toner of a corresponding developing unit in accordance with the detection data regarding the presence or the absence of the continuity state between the connection terminals 135*a* and 135*b*. Then, the data regarding the current remaining state of the toner in the abovementioned developing unit and the detection data are compared. When the current remaining state of the toner is small, the control circuit 145 transmits data to the display circuit 148 to display a time to replace the developing unit.

In case of the developing unit for exchange, since a filled amount of the toner is large, even when the remaining state of the toner is large, the toner deteriorates by being agitated. Therefore, a time to replace the developing unit is notified at a stage when the remaining state of the toner is still large. On the contrary, in case of the developing unit for initial mounting, since a filled amount of the toner is small, a time to replace the developing unit is notified at a stage when the remaining state of the toner is small.

Figure 13:
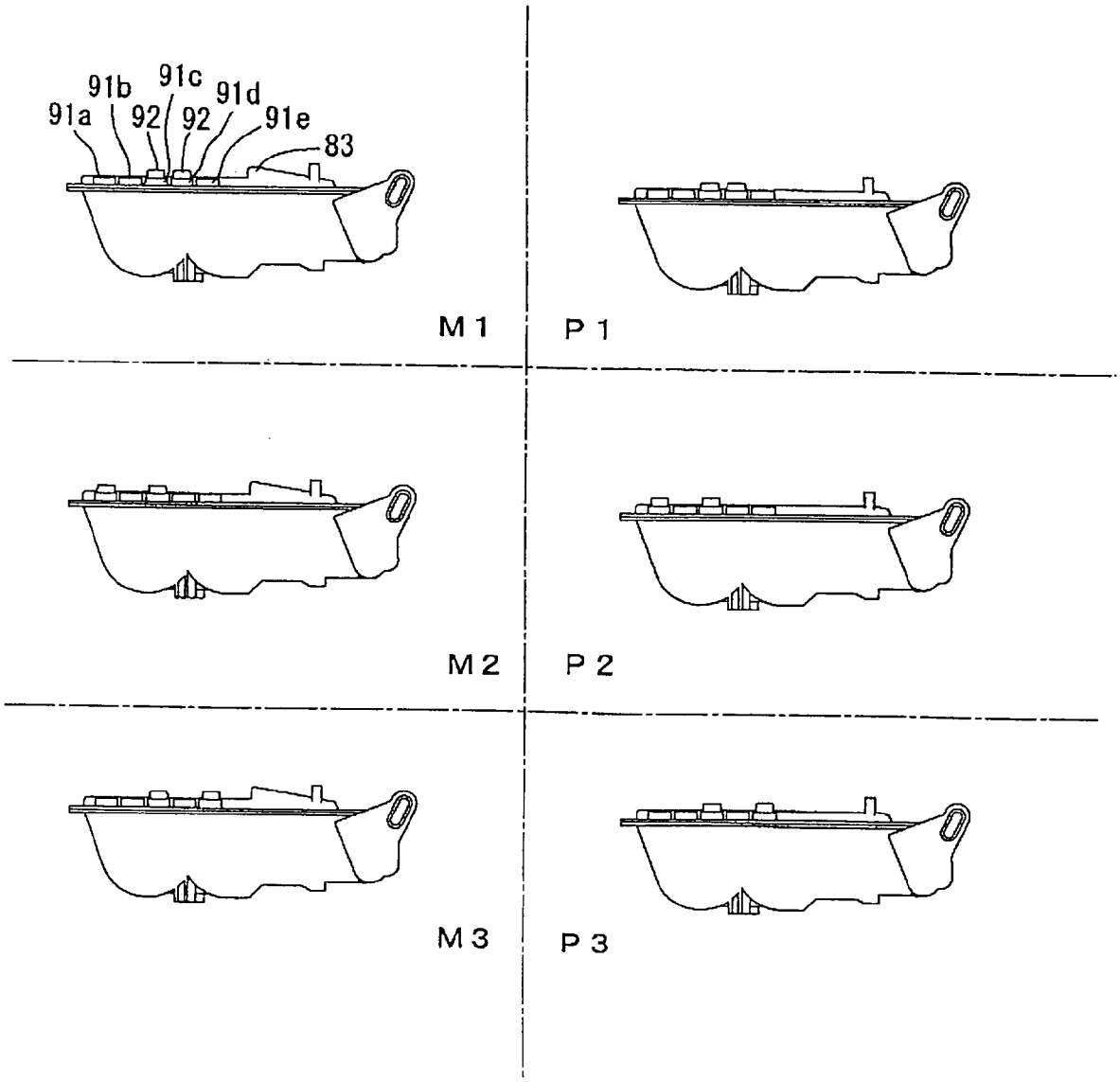
FIG. 13 shows examples of settings of leveled parts and identification protrusions of the developing unit.

FIG. 13 shows examples of ensuring the compatibility between the device frame and the developing unit by using the above (1) and (2). In the examples shown in FIG. 13, as the types of device frame, a group containing M1 to M3 and a group containing P1 to P3 are set. First, between each of the groups, a setting of the toner of the developing unit and the printing unit such as the photoconductive drum of the device frame is adjusted. For example, when forming an image with a high resolution, characteristics such as a diameter of a particle of the toner and the printing unit are adjusted to be optimum in response to the image forming process. Therefore, when a toner inappropriate for the image forming process is supplied, a sufficient resolution cannot be obtained. Thus, to distinguish the two groups, the compatibility is ensured by using the presence or the absence of the leveled part 83. The presence or the absence of the leveled part 83 can be recognized when inserting the developing unit into the device frame. Therefore, when there is no compatibility between the developing unit and the device frame, the developing unit cannot be inserted. In the group containing P1 to P3, only a developing unit without the leveled part 83 can be inserted. A developing unit with the leveled part 83 having compatibility with the group containing M1 to M3 cannot be inserted. Even when the developing unit is inserted forcibly by cutting off the leveled part 83, as described with reference to FIG. 6, a hole is formed through the developing unit and the toner leaks from the hole to cause troubles in the device frame. Moreover, the developing unit without the leveled part can be inserted in the device frame of the group containing M1 to M3. Therefore, two types of developing units can be used in the device frame of the group containing M1 to M3.

In each of the groups, when setting the compatibility by distinguishing the group into smaller groups, the compatibility can be set by combinations of the identification protrusions 92 fixed on the attaching portions 91*a* through 91*e* of the developing unit. When the compatibility of the leveled part 83 coincides, the developing unit can be inserted. However, when the compatibility of the identification protrusions 92 do not coincide with the device frame, the developing unit cannot be inserted completely into the device frame. Therefore, at this point in time, the developing unit is recognized to have no compatibility. In the examples shown in FIG. 13, by using two identification protrusions 92, three types of developing units within the group can be identified. In M1 and P1, the identification protrusions 92 are fixed on the attaching portions 91*c* and 91*d*. In M2 and P2, the identification protrusions 92 are fixed on the attaching portions 91*a* and 91*c*. In M3 and P3, the identification protrusions 92 are fixed on the attaching portions 91*c* and 91*e*. Therefore, as shown in FIG. 5, by fixing the identification engaging portion 96 on the device frame at a part corresponding to the position where the identification protrusion 92 is not fixed, only the developing unit having compatibility can be inserted into each type of device frame. Moreover, by reducing the number of the identification engaging portions 96 to be fixed, the number of types of developing units having compatibility can be increased. The patterns of the compatibility can be changed variously according to necessity.

The identification of the developing unit according to the detection of the presence or the absence of the continuity between the connection terminals 135*a* and 135*b* of the above (3) has been described to be used for the identification of the developing unit for initial mounting and the developing unit for exchange. When the compatibility of the leveled part 83 coincides and the compatibility by the combination of the identification protrusions 92 coincides, the developing unit is set at a prescribed inserting position. Then, the fourth connection member 127 makes contact with the connection terminals 135*a* and 135*b*. Therefore, the compatibility of the developing unit is ensured by triple identifications.

In case of the type which does not use the developing unit for exchange and uses only the developing unit for initial mounting, the detection of the presence or the absence of the above (3) is not necessary to be used for identifying the developing unit for initial mounting and the developing unit for exchange. In this case, as a default value, a flag identifying that the device is the type which uses only the developing unit for initial mounting and the data indicating the compatibility between the device frame and the developing unit can be stored in the storage circuit 146 of FIG. 12. When the identification flag is stored, the control circuit 145 compares the detection signal of the presence or the absence of-the continuity of the above (3) and the data indicating the compatibility. When the detection signal and the data correspond with one another, the control circuit 145 determines that there is compatibility between the device frame and the developing unit, and the subsequent process is executed. When the detection signal and the data do not correspond with one another, the subsequent process stops, and the control circuit controls to display an error on the display circuit 148. Other than the device for ensuring the compatibility mechanically as in the above (1) and (2), the compatibility can be ensured by the electrical device. Therefore, for example, by identifying the type of toner according to the detection of the presence or the absence of the continuity of the above (3), the compatibility of the type of toner can be ensured by both the mechanical and the electrical devices. As a result, the safety can be improved even more.

What is claimed is:

1. An image forming device, comprising:

a device frame;

a developing unit which is inserted into the device frame in a prescribed inserting direction;

two terminals which are provided in the device frame;

a metal conduction member which is provided in the developing unit and makes contact with at least one of the terminals; and a detecting unit which detects a presence or an absence of continuity between the terminals, wherein the developing unit comprises:

at least one identification protrusion which is fixed on an upper surface of the developing unit so as to protrude upward at a plurality of attaching portions arranged in a direction approximately orthogonal to the inserting direction, and a protrusion which is formed on the upper surface of the developing unit so as to protrude upward at a front side of the inserting direction more than the identification protrusion.

2. The image forming device according to claim 1, wherein the conduction member is a wire rod formed to make contact with both of the terminals or a wire rod formed to make contact with one of the terminals.

3. The image forming device according to claim 1, further comprising a determination unit which determines whether the developing unit is a developing unit for initial mounting or a developing unit for exchange in accordance with a signal from the detecting unit.

4. The image forming device according to claim 1, further comprising:

a fuse which is provided in the developing unit, wherein one terminal of the fuse is connected to one end of the conduction member and another terminal of the fuse is connected to another conduction member;

a terminal for the fuse which is provided in the device frame and makes contact with the other conduction member when inserting the developing unit; and a determination unit which determines whether the developing unit is old or new by energizing between one of the terminals and the terminal for the fuse, blowing out the fuse and detecting a presence or an absence of continuity between the one of the terminals and the terminal for the fuse.

5. The image forming device according to claim 1, wherein an inner part of the protrusion is a gap connected with an inner part of the developing unit.

6. The image forming device according to claim 1, wherein the identification protrusion is fixed on a position of the attaching portions based on a combination determined according to a type of developing unit.

7. The image forming device according to claim 1; wherein the conduction member is set at a length to bring between the two terminals into conduction or non-conduction.

8. The image forming device according to claim 1, further comprising:

a storage unit which stores an identification flag for identifying a type of image forming device and compatibility information indicating compatibility between the image forming device and the developing unit; and a determination unit which determines whether a detection signal of the detecting unit and the compatibility information correspond with one another when there is the identification flag.

9. The image forming device according to claim 8, wherein the conduction member is a wire rod formed to make contact with both of the terminals or a wire rod formed to make contact with one of the terminals.

10. The image forming device according to claim 8, wherein when there is no identification flag, the determination unit determines whether the developing unit is for initial mounting or for exchange in accordance with the detection signal from the detecting unit.

11. An image forming device, comprising:

a device frame;

a developing unit which is inserted into the device frame in a prescribed inserting direction;

two terminals which are provided in the device frame;

a metal conduction member which is provided in the developing unit and makes contact with at least one of the terminals;

a detecting unit which detects a presence or an absence of continuity between the terminals;

a storage unit which stores an identification flag for identifying a type of image forming device and compatibility information indicating compatibility between the image forming device and the developing unit; and a determination unit which determines whether a detection signal of the detecting unit and the compatibility information correspond with one another when there is the identification flag, wherein the developing unit comprises:

at least one identification protrusion which is fixed on an upper surface of the developing unit so as to protrude upward at a plurality of attaching portions arranged in a direction approximately orthogonal to the inserting direction, and a protrusion which is formed on the upper surface of the developing unit so as to protrude upward at a front side of the inserting direction more than the identification protrusion.

12. The image forming device according to claim 11, wherein the conduction member is a wire rod formed to make contact with both of the terminals or a wire rod formed to make contact with one of the terminals.

13. The image forming device according to claim 11, wherein when there is no identification flag, the determination unit determines whether the developing unit is for initial mounting or for exchange in accordance with the detection signal from the detecting unit.

14. The image forming device according to claim 11, further comprising:

a fuse which is provided in the developing unit, wherein one terminal of the fuse is connected to one end of the conduction member and another terminal of the fuse is connected to another conduction member;

a terminal for the fuse which is provided in the device frame and makes contact with the other conduction member when inserting the developing unit; and a determination unit which determines whether the developing unit is old or new by energizing between one of the terminals and the terminal for the fuse, blowing out the fuse and detecting a presence or an absence of continuity between the one of the terminals and the terminal for the fuse.

15. The image forming device according to claim 11, wherein an inner part of the protrusion is a gap connected with an inner part of the developing unit.

16. The image forming device according to claim 11, wherein the identification protrusion is fixed on a position of the attaching portions based on a combination determined according to a type of developing unit.

17. The image forming device according to claim 11, wherein the conduction member is set at a length to bring between the two terminals into conduction or non-conduction.

18. A developing unit, comprising:

at least one identification protrusion which is fixed on an upper surface of the developing unit so as to protrude upward at a plurality of attaching portions arranged in a direction approximately orthogonal to the inserting direction;

a protrusion which is formed on the upper surface of the developing unit so as to protrude upward at a front side of the inserting direction more than the identification protrusion; and a metal conduction member which makes contact with a terminal of an image forming device.

19. The developing unit according to claim 18, wherein an inner part of the protrusion is a gap connected with an inner part of the developing unit.

20. The developing unit according to claim 18, wherein the identification protrusion is fixed on a position of the attaching portions based on a combination determined according to a type of developing unit.

21. The developing unit according to claim 18, wherein the conduction member is set at a length to bring between the two terminals into conduction or non-conduction.

* * * * *